US007808465B2

(12) United States Patent
Hsueh

(10) Patent No.: US 7,808,465 B2
(45) Date of Patent: Oct. 5, 2010

(54) GAMMA VOLTAGE GENERATOR, SOURCE DRIVER, AND DISPLAY DEVICE UTILIZING THE SAME

(75) Inventor: Wei-Chieh Hsueh, Tainan (TW)

(73) Assignee: Wisepal Technologies, Inc., Miao-Li County (TW)

( * ) Notice: Subject to any disclaimer, the term of this patent is extended or adjusted under 35 U.S.C. 154(b) by 1017 days.

(21) Appl. No.: 11/551,817

(22) Filed: Oct. 23, 2006

(65) Prior Publication Data

US 2008/0030444 A1 Feb. 7, 2008

(30) Foreign Application Priority Data

Jul. 25, 2006 (TW) ..... 95127095 A

(51) Int. Cl.
*G09G 3/36* (2006.01)

(52) U.S. Cl. ..... 345/87; 345/88

(58) Field of Classification Search ..... 345/87, 345/88, 89, 98, 99, 100, 204, 211, 690, 694; 348/671, 674; 341/141, 154
See application file for complete search history.

(56) References Cited

U.S. PATENT DOCUMENTS 7,187,375 B2 * 3/2007 Ha et al. ..... 345/212
7,298,352 B2 * 11/2007 Kang et al. ..... 345/87
7,388,592 B2 * 6/2008 Chuang et al. ..... 345/690

* cited by examiner

*Primary Examiner*—Abbas I Abdulselam
(74) *Attorney, Agent, or Firm*—Thomas, Kayden, Horstemeyer & Risley

(57) ABSTRACT

A gamma voltage generator generating a plurality of gamma voltages transformed into a plurality of data signals by a processing unit is disclosed. The processing unit outputs the data signals according to a color separation method. The gamma voltage generator comprises a setting unit, a resistor string, and a selection unit. The setting unit provides a first parameter, a second parameter, and a third parameter. The resistor string generates the gamma voltages according to the first, second, or third parameter. The selection unit is coupled between the setting unit and the resistor string for outputting the first, second, or third parameter to the resistor string according to a control signal group.

20 Claims, 4 Drawing Sheets

GAMMA VOLTAGE GENERATOR, SOURCE DRIVER, AND DISPLAY DEVICE UTILIZING THE SAME

BACKGROUND OF THE INVENTION

1. Field of the Invention

The invention relates to a gamma voltage generator, and more particularly to a gamma voltage generator utilizing only a resistor string.

2. Description of the Related Art

Liquid crystal displays (LCDs) are widely used due to their favorable advantages, which include thin profile, low weight, and low radiation,. A display array of one LCD comprises a plurality of pixel units. Each pixel unit comprises a red sub-pixel, a green sub-pixel, and a blue sub-pixel. The brightness of each sub-pixel is determined according to its gamma voltage.

FIG. 1 is a schematic diagram of a conventional gamma voltage generator. Conventional gamma voltage generator 10 comprises setting units 121~123 and gamma circuits 141~143. Each of the gamma circuits 141~143 is a resistor string.

Gamma circuit 141 generates point voltages $V_{R1}$~$V_{Rn}$ for controlling brightness of red sub-pixels (not shown) when setting unit 121 provides a setting signal $S_{S121}$ to the gamma circuit 141.

Gamma circuit 142 generates point voltages $V_{G1}$~$V_{Gn}$ for controlling brightness of green sub-pixels (not shown) when the setting unit 122 provides a setting signal $S_{S122}$ to the gamma circuit 142.

Gamma circuit 143 generates point voltages $V_{B1}$~$V_{Bn}$ for controlling brightness of blue sub-pixels (not shown) when the setting unit 123 provides a setting signal $S_{S123}$ to the gamma circuit 143.

To display different levels of brightness, the sum of the resistors is increased. When the sum of the resistors of gamma circuit 141 is increased, the sum of the resistors of gamma circuits 142 and 143 must be increased, thus, the cost of gamma circuits is increased and usable space is reduced.

BRIEF SUMMARY OF THE INVENTION

Gamma voltage generators are provided. An exemplary embodiment of a gamma voltage generator generates a plurality of gamma voltages for transformation into a plurality of data signals by a processing unit. The processing unit outputs the data signals according to a color separation method. The gamma voltage generator comprises a setting unit, a resistor string, and a selection unit. The setting unit provides a first parameter, a second parameter, and a third parameter. The resistor string generates the gamma voltages according the first, second, or third parameter. The selection unit is coupled between the setting unit and the resistor string for outputting the first, second, or third parameter to the resistor string according to a control signal group.

Source drivers are also provided. An exemplary embodiment of a source driver provides a plurality of data signals to a plurality of first sub-pixels, a plurality of second sub-pixels, or a plurality of third sub-pixels according to a color separation method. The first, the second, and the third sub-pixels respectively display a first, a second, and a third color component. The source driver comprises a gamma voltage generator and a processing unit. The gamma voltage generator provides a plurality of gamma voltages and comprises a setting unit, a resistor string, and a selection unit. The setting unit provides a first parameter, a second parameter, and a third parameter. The resistor string generates the gamma voltages according to the first, second, or third parameter. The selection unit is coupled between the setting unit and the resistor string for outputting the first, second, or third parameter to the resistor string according to a control signal group. The processing unit transforms the gamma voltages into the data signals and outputs the data signals to the first, second, or third sub-pixels.

Display devices are also provided. An exemplary embodiment of a display device comprises a display array, a gate driver, and a source driver. The display array comprises a plurality of first sub-pixels, a plurality of second sub-pixels, and a plurality of third sub-pixels. The first sub-pixels display a first color component. The second sub-pixels display a second color component. The third sub-pixels display a third color component. The gate driver provides a plurality of scan signals to the display array. The source driver provides a plurality of data signals to the display array according to a color separation method and comprises a gamma voltage generator and a processing unit. The gamma voltage generator provides a plurality of gamma voltages and comprises a setting unit, a resistor string, and a selection unit. The setting unit provides a first parameter, a second parameter, and a third parameter. The resistor string generates the gamma voltages according to the first, second, or third parameter. The selection unit is coupled between the setting unit and the resistor string for outputting the first, second, or third parameter to the resistor string according to a control signal group. The processing unit transforms the gamma voltages into the data signals and outputs the data signals to the first, second, or third sub-pixel.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
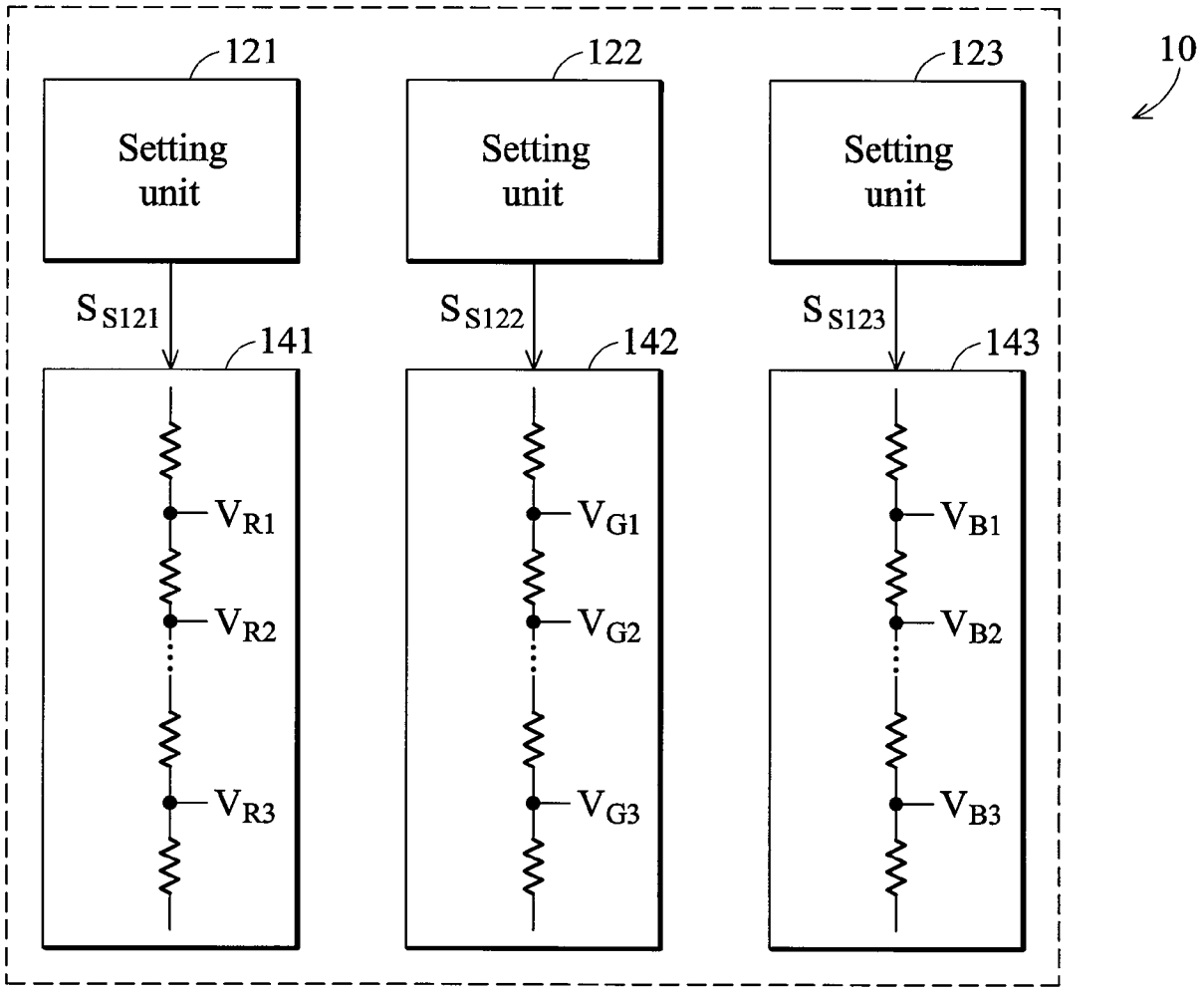
FIG. 1 (RELATED ART)
FIG. 1 is a schematic diagram of a conventional gamma voltage generator.
Figure 2:
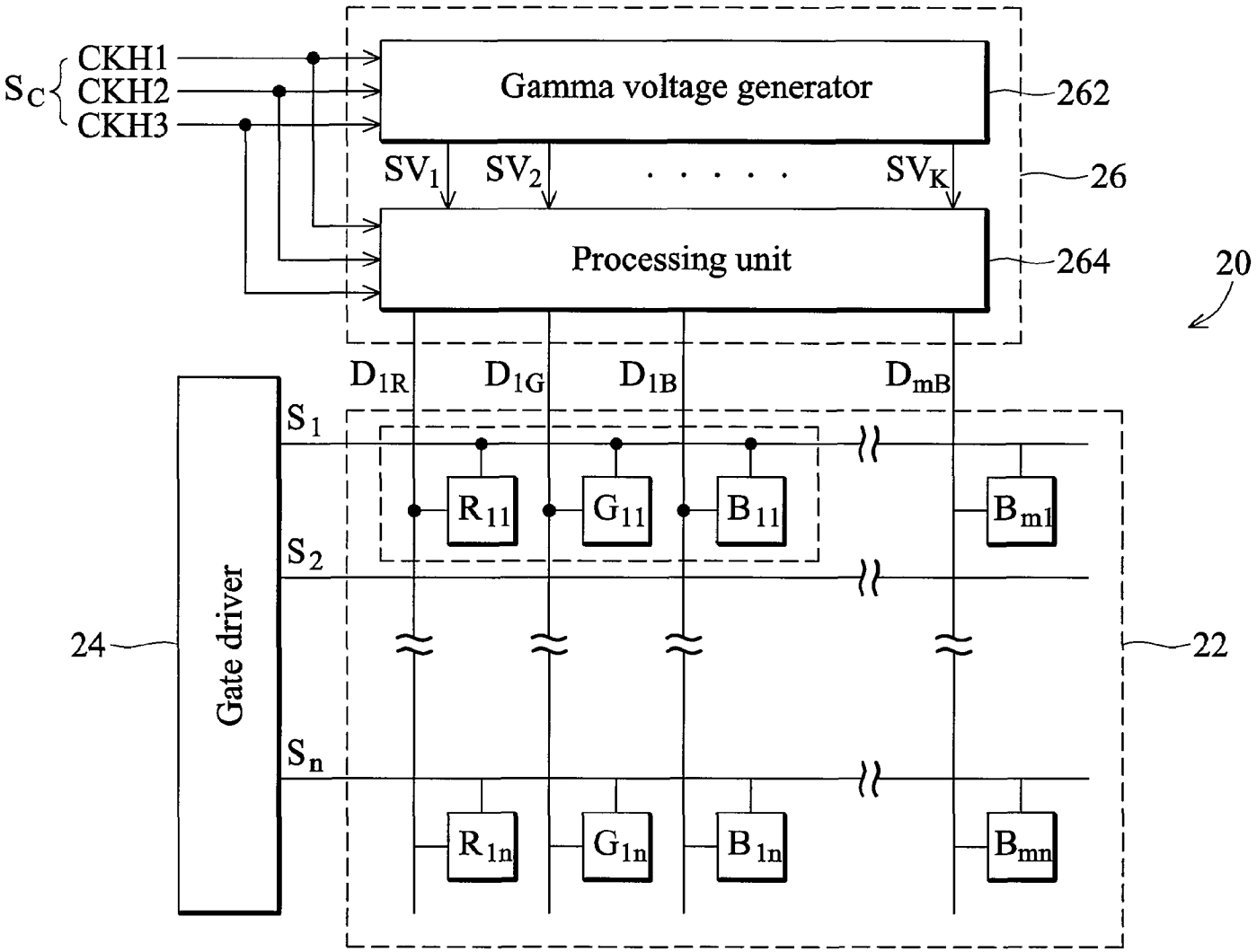
FIG. 2 is a schematic diagram of an exemplary embodiment of a display device.

FIG. 2 is a schematic diagram of an exemplary embodiment of a display device. Display device 20 comprises a display array 22, a gate driver 24, and a source driver 26. Display array 22 comprises a plurality of pixel units. Each pixel unit comprises three sub-pixels. The sub-pixels display different colors. In this embodiment, sub-pixels $R_{11}$~$R_{mn}$ display the red component, sub-pixels $G_{11}$~$G_{mn}$ display the green component, and sub-pixels $B_{11}$~$B_{mn}$ display the blue component.

The gate driver 24 provides scan signals $S_1$~$S_n$ to display array 22 for turning on all sub-pixels in the same row. Source driver 26 provides data signals $D_{1R}$~$D_{mB}$ to display array 22 according to a color separation method such that display array 22 displays an image.

In this embodiment, source driver 26 utilizes the color separation method to first provide data signals $D_{1R}$~$D_{mR}$ to sub-pixels $R_{11}$~$R_{mn}$, then provide data signals $D_{1G}$~$D_{mG}$ to sub-pixels $G_{11}$~$G_{mn}$, and finally provide data signals $D_{1B}$~$D_{mB}$ to sub-pixels $B_{11}$~$B_{mn}$.

Since sub-pixels $R_{11}$~$R_{mn}$ display the red component, sub-pixels $G_{11}$~$G_{mn}$ display the green component, and sub-pixels $B_{11}$~$B_{mn}$ display the blue component, display array 22 first displays red, then green, and finally blue.

Source driver 26 comprises a gamma voltage generator 262 and a processing unit 264. Gamma voltage generator 262 provides gamma voltages $SV_1$~$SV_K$. Processing unit 264 transforms gamma voltages $SV_1$~$SV_K$ into data signals $D_{1R}$~$D_{mB}$ and outputs data signals $D_{1R}$~$D_{mB}$ to one group of sub-pixels $R_{11}R_{mn}$, $G_{11}$~$G_{mn}$, or $B_{11}$~$B_{mn}$.

Figure 3:
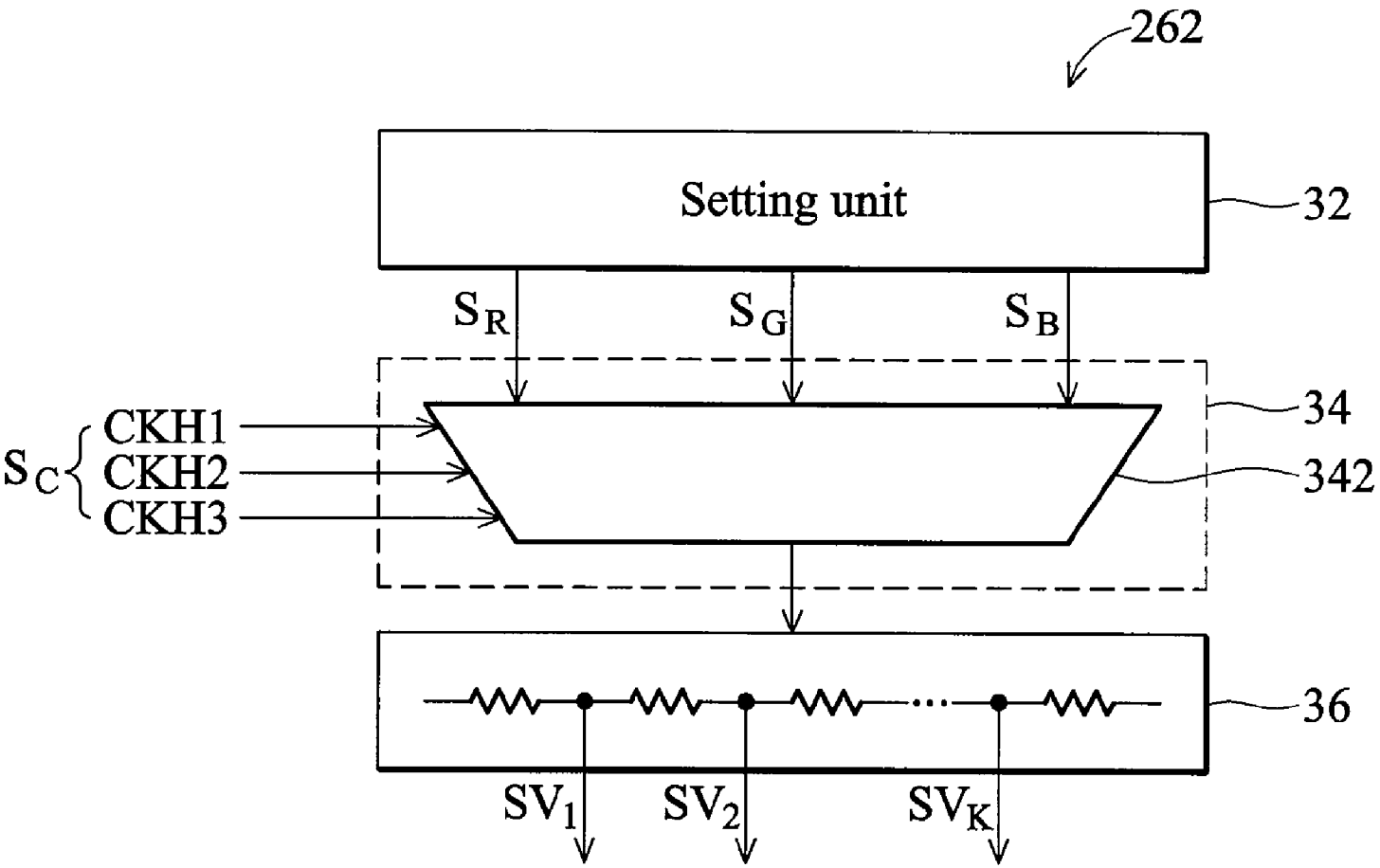
FIG. 3 is a schematic diagram of an exemplary embodiment of the gamma voltage generator.

FIG. 3 is a schematic diagram of an exemplary embodiment of the gamma voltage generator. Gamma voltage generator 262 comprises a setting unit 32, a selection unit 34, and a resistor string 36. Setting unit 32 provides parameters $S_R$, $S_G$, and $S_B$. Selection unit 34 outputs one parameter $S_R$, $S_G$, or $S_B$. Resistor string 36 generates gamma voltages $SV_1$~$SV_K$ according to an output signal output from selection unit 34.

In this embodiment, selection unit 34 is a multiplexer 342. When a control signal CKH1 of the control signal group $S_C$ is asserted, multiplexer 342 outputs parameter $S_R$. When a control signal CKH2 of the control signal group $S_C$ is asserted, multiplexer 342 outputs parameter $S_G$. When a control signal CKH3 of the control signal group $S_C$ is asserted, multiplexer 342 outputs parameter $S_B$.

When resistor string 36 receives parameter $S_R$, a first gamma curve is determined according to gamma voltages $SV_1$~$SV_K$ generated by resistor string 36. When resistor string 36 receives parameter $S_G$, a second gamma curve is determined according to gamma voltages $SV_1$~$SV_K$ generated by resistor string 36. When resistor string 36 receives parameter $S_B$, a third gamma curve is determined according to gamma voltages $SV_1$~$SV_K$ generated by resistor string 36.

Although gamma voltage generator 262 only comprises one resistor string, selection unit 34 selectively outputs one parameter $S_R$, $S_G$, or $S_B$ to the resistor string for generating gamma voltages $SV_1$~$SV_K$. Thus, three gamma curves are determined by gamma voltages $SV_1$~$SV_K$.

Figure 4:
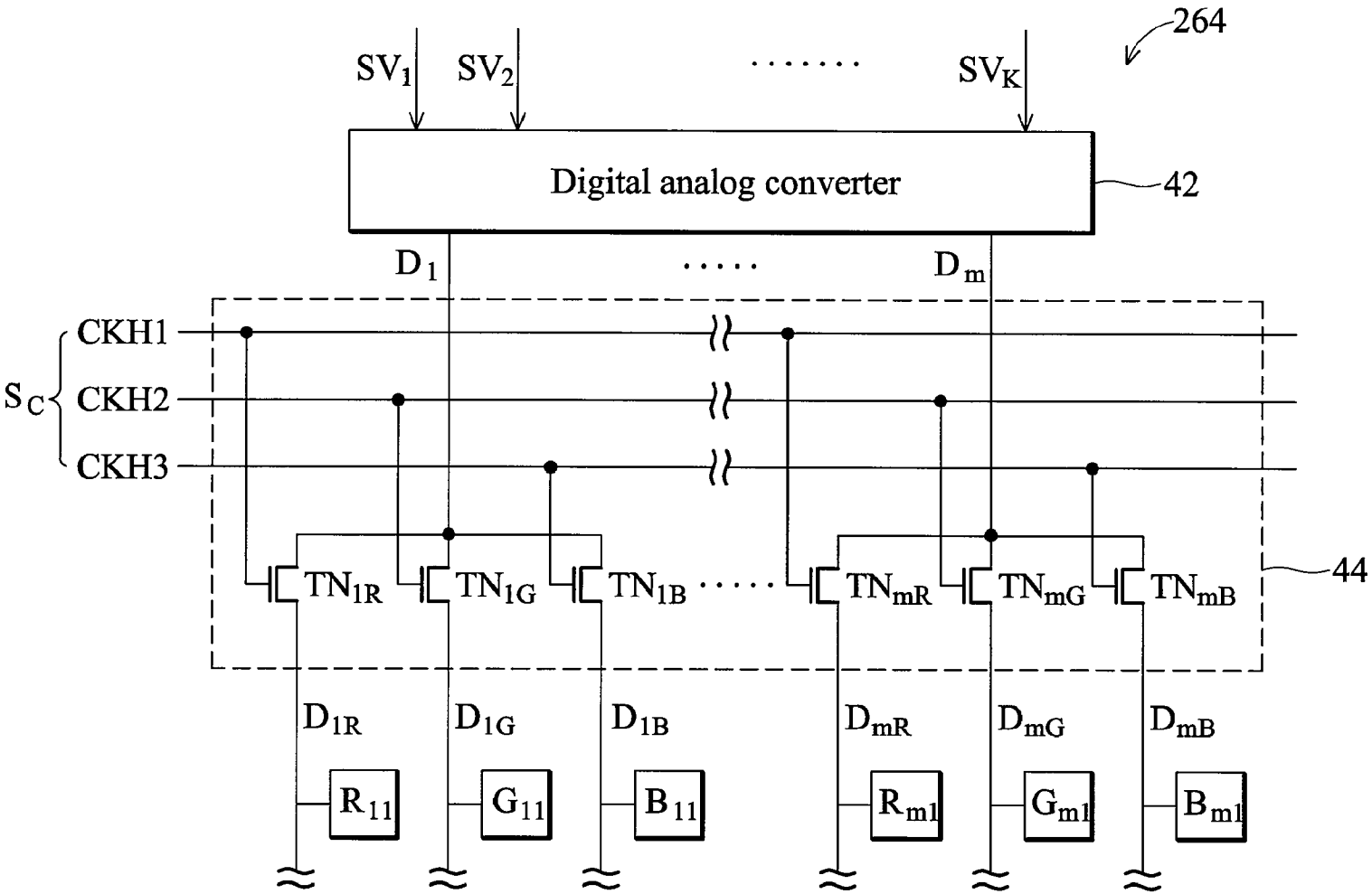
FIG. 4 is a schematic diagram of an exemplary embodiment of the processing unit.

FIG. 4 is a schematic diagram of an exemplary embodiment of the processing unit. Processing unit 264 comprises a digital analog converter 42 and a switching unit 44. Digital analog converter 42 transforms gamma voltages $SV_1$~$SV_K$ into data signals $D_1$~$D_m$. Switching unit 44 outputs data signals $D_1$~$D_m$ to sub-pixels $R_{11}$~$R_{mn}$, $G_{11}$~$G_{mn}$, or $B_{11}$~$B_{mn}$ according to the control signal group $S_C$.

In this embodiment, switching unit 44 comprises transistors $TN_{1R}$~$TN_{mB}$. When the control signal CKH1 is asserted, transistors $TN_{1R}$~$TN_{mR}$ outputs data signals $D_1$~$D_m$ to sub-pixels $R_{11}$~$R_{m1}$ for displaying the red component. When the control signal CKH2 is asserted, transistors $TN_{1G}$~$TN_{mG}$ output data signals $D_1$~$D_m$ to sub-pixels $G_{11}$~$G_{m1}$ for displaying the green component. When the control signal CKH3 is asserted, transistors $TN_{1B}$~$TN_{mB}$ output data signals $D_1$~$D_m$ to sub-pixels $B_{11}$~$B_{m1}$ for displaying the blue component.

Because the control signals CKH1~CKH3 are asserted in succession, data signals $D_1$~$D_m$ are transmitted in succession to sub-pixels $R_{11}$~$R_{m1}$, $G_{11}$~$G_{m1}$, and $B_{11}$~$B_{m1}$. Thus, first sub-pixels $R_{11}$~$R_{m1}$ display the red component, then sub-pixels $G_{11}$~$G_{m1}$ display the green component, and finally sub-pixels $B_{11}$~$B_{m1}$ display the blue component.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A gamma voltage generator generating gamma voltages transformed into data signals by a processing unit, wherein the processing unit outputs the data signals according to a color separation method, comprising:

a setting unit providing a first parameter, a second parameter, and a third parameter;

a resistor string generating the gamma voltages according to the first, second, or third parameter; and a selection unit coupled between the setting unit and the resistor string for outputting the first, second, or third parameter to the resistor string according to a control signal group.

2. The gamma voltage generator as claimed in claim 1, wherein the selection unit is a multiplexer.

3. The gamma voltage generator as claimed in claim 1, wherein the processing unit outputs the data signals to a plurality of first sub-pixels, a plurality of second sub-pixels, or a plurality of third sub-pixels according to the control signal group.

4. The gamma voltage generator as claimed in claim 3, wherein the first sub-pixels display a red component, the second sub-pixels display a green component, and the third sub-pixels display a blue component.

5. The gamma voltage generator as claimed in claim 3, wherein the processing unit outputs the data signals to the first sub-pixels when the resistor string receives the first parameter, the processing unit outputs the data signals to the second sub-pixels when the resistor string receives the second parameter, and wherein the processing unit outputs the data signals to the third sub-pixels when the resistor string receives the third parameter.

6. The gamma voltage generator as claimed in claim 1, wherein a first gamma curve is obtained according to the gamma voltages when the resistor string receives the first parameter, a second gamma curve is obtained according to the gamma voltages when the resistor string receives the second parameter, and a third gamma curve is obtained according to the gamma voltages when the resistor string receives the third parameter.

7. A source driver providing data signals to a plurality of first sub-pixels, a plurality of second sub-pixels, or a plurality of third sub-pixels, according to a color separation method and wherein the first, the second, and the third sub-pixels respectively display a first, a second, and a third color component, comprising:

a gamma voltage generator providing gamma voltages and comprising:

a setting unit providing a first parameter, a second parameter, and a third parameter;

a resistor string generating the gamma voltages; and a selection unit outputting the first, second, or third parameter to the resistor string according to a control signal group; and a processing unit transforming the gamma voltages into the data signals and outputs the data signals to the first, second, or third sub-pixel.

8. The source driver as claimed in claim 7, wherein the processing unit comprises:

a digital analog converter transforming the gamma voltages into the data signals; and a switching unit outputting the data signals to the first, second, or third sub-pixel according to the control signal group.

9. The source driver as claimed in claim 8, wherein the switching unit comprises:

a plurality of first transistors outputting the data signals to the first sub-pixels according to the control signal group;

a plurality of second transistors outputting the data signals to the second sub-pixels according to the control signal group; and a plurality of third transistors outputting the data signals to the third sub-pixels according to the control signal group.

10. The source driver as claimed in claim 7, wherein the selection unit is a multiplexer.

11. The source driver as claimed in claim 7, wherein a first color component is a red component, a second color component is a green component, and a third color component is a blue component.

12. The source driver as claimed in claim 7, wherein the processing unit outputs the data signals to the first sub-pixels when the resistor string receives the first parameter, the processing unit outputs the data signals to the second sub-pixels when the resistor string receives the second parameter, and wherein the processing unit outputs the data signals to the third sub-pixels when the resistor string receives the third parameter.

13. The source driver as claimed in claim 7, wherein a first gamma curve is obtained according to the gamma voltages when the resistor string receives the first parameter, a second gamma curve is obtained according to the gamma voltages when the resistor string receives the second parameter, and a third gamma curve is obtained according to the gamma voltages when the resistor string receives the third parameter.

14. A display device, comprising:

a display array comprising a plurality of first sub-pixels, a plurality of second sub-pixels, and a plurality of third sub-pixels, wherein the first sub-pixels display a first color component, the second sub-pixels display a second color component, and the third sub-pixels display a third color component;

a gate driver providing a plurality of scan signals to the display array; and a source driver providing data signals to the display array according to a color separation method and comprising:

a gamma voltage generator providing gamma voltages and comprising:

a setting unit providing a first parameter, a second parameter, and a third parameter;

a resistor string generating the gamma voltages; and a selection unit outputting the first, second, or third parameter to the resistor string according to a control signal group; and a processing unit transforming the gamma voltages into the data signals and outputs the data signals to the first, second, or third sub-pixel.

15. The display device as claimed in claim 14, wherein the processing unit comprises:

a digital analog converter transforming the gamma voltages into the data signals; and a switching unit outputting the data signals to the first, second, or third sub-pixel according to the control signal group.

16. The display device as claimed in claim 15, wherein the switching unit comprises:

a plurality of first transistors outputting the data signals to the first sub-pixels according to the control signal group;

a plurality of second transistors outputting the data signals to the second sub-pixels according to the control signal group; and a plurality of third transistors outputting the data signals to the third sub-pixels according to the control signal group.

17. The display device as claimed in claim 14, wherein the selection unit is a multiplexer.

18. The display device as claimed in claim 14, wherein the first color component is a red component, the second color component is a green component, and the third color component is a blue component.

19. The display device as claimed in claim 14, wherein the processing unit outputs the data signals to the first sub-pixels when the resistor string receives the first parameter, the processing unit outputs the data signals to the second sub-pixels when the resistor string receives the second parameter, and wherein the processing unit outputs the data signals to the third sub-pixels when the resistor string receives the third parameter.

20. The display device as claimed in claim 14, wherein a first gamma curve is obtained according to the gamma voltages when the resistor string receives the first parameter, a second gamma curve is obtained according to the gamma voltages when the resistor string receives the second parameter, and a third gamma curve is obtained according to the gamma voltages when the resistor string receives the third parameter.

* * * * *